United States Patent [19]

Kohorn

[11] 4,068,500

[45] Jan. 17, 1978

[54] KNITTING MACHINE NEEDLE WITH FRONT AND BACK CUT-OUTS AND SPRING

[76] Inventor: Alfred O. Kohorn, 862 Wyckoff Ave., Brooklyn, N.Y. 11227

[21] Appl. No.: 685,970

[22] Filed: May 13, 1976

[51] Int. Cl.[2] ..... D04B 35/04

[52] U.S. Cl. ..... 66/123

[58] Field of Search ..... 66/123, 124, 121

[56] References Cited

U.S. PATENT DOCUMENTS

| | | | |
|---|---|---|---|
| 1,178,682 | 4/1916 | Scott | 66/124 |
| 1,184,526 | 5/1916 | Harley | 66/123 |
| 2,626,515 | 1/1953 | Pierre | 66/123 X |
| 3,464,237 | 9/1969 | Kohorn | 66/123 |
| 3,712,082 | 1/1973 | Kohorn | 66/124 X |
| 3,874,199 | 4/1975 | Mayer et al. | 66/123 X |
| 3,875,767 | 4/1975 | Kopal et al. | 66/123 |
| 3,994,145 | 11/1976 | Stolz | 66/123 |

FOREIGN PATENT DOCUMENTS

| | | | |
|---|---|---|---|
| 1,635,837 | 1/1970 | Germany | 66/121 |
| 2,408,567 | 9/1975 | Germany | 66/121 |

*Primary Examiner*—Mervin Stein
*Assistant Examiner*—A. M. Falik
*Attorney, Agent, or Firm*—Irvin A. Lavine

[57] ABSTRACT

A knitting machine needle is provided for a dial and cylinder circular knitting machine having the needle shank integral with the needle hook portion, the shank having one or more cutouts which are located at both the front and back thereof. The cutouts are defined by edges which include arcuate portions, or only straight edge portions wherein the edges are in part inclined to the needle longitudinal axis; further a spring may be provided on the side of the shank and have one end anchored to the shank, the spring being located as close as possible to the needle hook, and underlying the butt closest to the needle hook, or at least the forward portion of the shank if there is no forward butt. Such spring may also be positioned on a needle having front and back cutouts with edges at 90° to each other.

3 Claims, 12 Drawing Figures

KNITTING MACHINE NEEDLE WITH FRONT AND BACK CUT-OUTS AND SPRING

BACKGROUND OF THE INVENTION

The present invention relates to knitting needles for use in circular knitting machines of the dial and cylinder type.

Such knitting machines have long been known and used for the production of knitted goods. Such machines are capable of the fastest and highest production of any machines known. Efforts have been made, nevertheless, to increase the speed at which the machines operate, which is their rotational speed, and these efforts have included improved construction of the needles used in such machines. Examples of improved needle constructions are found in U.S. Pat. No. 3,464,237 to Alfred O. Kohorn, characterized by a needle having an integral shank and needle portion with cutouts on the back of the shank to reduce the needle weight and the needle contact area. Also, in U.S. Pat. No. 3,712,082 to Alfred O. Kohorn, there was disclosed the combination with a circular dial and cylinder type knitting machine of a thin guage straight unbent needle pressed against one groove side by a spring carried by the needle so that the spring engaged the opposite groove side in all positions of the needle. While such needles have proven successful in use, there have nevertheless been experienced the occasion of needle breakage, as machines have been run at ever higher speeds.

Needle breakage is due to vibration of the hook portions of the needles, which vibrations may result in the hook of one needle striking the hook of another needle, or simply due to metal fatigue. In the latter case, although there may not be actual striking of one needle against another, the metal of which the needle is made is reduced in strength by the fatigue induced by vibrations, so that even when normal loads are placed on the needle during its operation, they are sufficient to cause the needle to break.

Needle breakage is undesirable because with a hook of a needle broken off, that needle fails to knit, and accordingly the product produced is defective. Consequently, the machine must be shut down in order to replace the needle, thereby resulting in down time of the machine and loss of productivity.

Consideration of the problem of needle vibration, and particularly vibration of the hook, indicates that vibration in the needle is generated by the engagement of a butt or butts with the parts of the machine which define and provide the cam with which the butt engages in order to move the needle to and from knitting position in its groove. Thus, the vibrations are generated at the butt, and while they travel into the needle from the portion of the needle underlying or immediately adjacent the butt, the vibrations travel towards the forward end of the needle. The vibrations which reach the hook of the needle cause it to vibrate, with the deletorious effects above noted.

SUMMARY OF THE INVENTION

The present invention provides a knitting machine needle of unique configuration and having various features which may be utilized singly or together. The needle is made of sheet metal which is generally rectangular in transverse cross section, having a shank with a front from which one or more butts extend, a back for engaging the bottom of the needle groove, and an integral hook extending from the shank. There are provided cutouts to attenuate and diminish vibration on both the front and back of the needle shank, these being defined by an edge generally parallel to the longitudinal axis of the shank, and additional edges that are arcuate, or straight and inclined to the said longitudinal axis. Such needles, in an aspect of the invention, are each provided with a spring located under the butt closest to the hook, or if there is a butt only on the rear portion of the needle, the spring is located on the forward portion of the needle, so that in either location, vibrations approaching the hook, even past the noted cutouts, are attenuated. Further, such spring is provided and so located on a needle having top and bottom cutouts; wherein all edges of the cutouts are at right angles to adjacent edges of the cutouts.

Among the objects of the invention are the provision of a knitting machine needle for a circular dial and cylinder knitting machine having provision to diminish and attenuate vibrations introduced into the needle by engagement of butts with cams as the vibrations pass towards the hook. Another object of the present invention is to provide a needle with such cutouts and with a spring so located as to intercept and attenuate vibrations passing towards the hook. A still further and broader object of the present invention is to provide knitting machine needles which will permit circular dial and cylinder type knitting machines to be run at higher speeds, with improved performance as related to needle breakage.

DESCRIPTION OF THE PREFERRED EMBODIMENTS

Figures 1, 1A, 1B, 2, 2A, 3, 3A, 4, 4A, 5, 5A, 6:
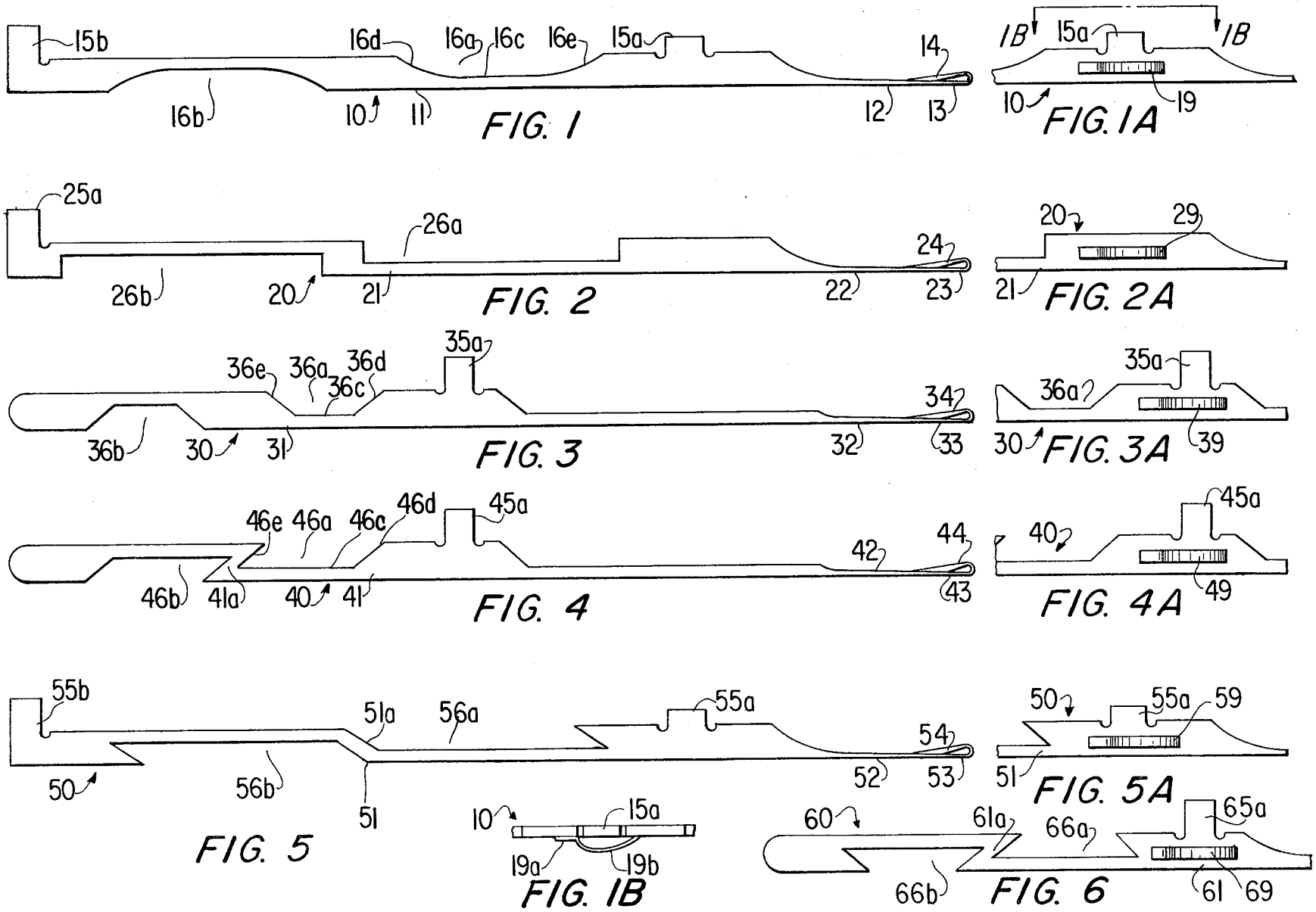
FIG. 1 is an elevational view of a needle in accordance with the present invention, having front and back cutouts defined in part by arcuate lines.
FIG. 1A is a partial view of a needle as in FIG. 1, and having a spring.
FIG. 1B is a view taken on line 1B—1B of FIG. 1A.
FIG. 2 is an elevational view of a needle similar to FIG. 1, with the cutouts defined by straight lines at right angles.
FIG. 2A is a partial view of a needle as in FIG. 2, and having a spring.
FIG. 3 is an elevational view of a needle having front and back cutouts defined by straight lines intersecting at angles greater than 90°.
FIG. 3A is a partial view of a needle as in FIG. 3, and having a spring.
FIG. 4 is an elevational view of a needle having front and back cutouts defined by edges intersecting at angles more and less than 90°.
FIG. 4A is a partial view of a needle as in FIG. 4, and having a spring.
FIG. 5 shows another embodiment of a needle generally similar to FIG. 4.
FIG. 5A is a partial view of a needle as in FIG. 5, and having a spring.
FIG. 6 is a partial view of a needle having front and back cutouts with straight lines intersecting at angles less than 90°, and having a spring.

Referring now to the drawings, wherein like or corresponding reference numerals are used for like or corresponding parts throughout the several embodiments, there is shown in FIG. 1 a knitting machine needle generally designated 10, which is,like all the needles illustrated and disclosed, intended for use in a high speed circular knitting machine having a dial and a cylinder. As is known, such machines are provided with needle grooves and cams for moving the needles in the grooves. The needle itself is made of flat sheet metal, usually stamped as an initial manufacturing step, the sheet metal being generally rectangular in transverse cross section. The needle 10 has a shank 11 and an integral needle portion 12 with a hook 13 and a pivoted latch 14. The needle is provided with a front butt 15*a* and a rear butt 15*b*, which extend from the front of the needle. The back of the needle is that edge of the needle which engages the bottom of the needle slot, of the knitting machine, and in accordance with the present invention in order to provide for attenuation of vibrations transmitted to the needle hook 13, there are provided a front cutout generally designated 16*a* and a back cutout generally designated 16*b*. As is apparent, each of the cutouts is formed by three lines; thus, for the cutout 16*a*, there is a bounding straight edge or line 16*c* which extends parallel to the needle shank longitudinal axis, and a pair of arcuate end lines, which are designated 16*d* and 16*e*.

FIG. 1A is a partial view of a needle 10 having substantially the same shape and configuration as the needle 10 of FIG. 1, and provided with a spring 19 secured to the side of the shank of the needle 10, the spring being of the leaf-spring type, having a flat end 19*a* and an integral arcuate portion 19*b* (see FIG. 1B) that terminates in a free end that is closest to the hook 13. Thus, the spring 19 may be substantially similar to the spring illustrated in Kohorn U.S. Pat. No. 3,712,082. The spring 19 is located on a side of the shank, and underlies the butt 15*a*, which is the butt that is closest to the hook of the needle. Vibrations introduced into the needle 10 by engagement of one or more of the butts 15*a* and 15*b* will be attenuated by the shape and configuration of the needle shank, which is characterized by the front and back cutouts; in addition, the spring 19 will cause the side of the shank which is opposite to that shown in FIG. 1A to be pressed into engagement with the side of the needle groove in which the needle 10 moves, since the convex face of portion 19*b* of spring 19 will engage with the opposite side of the groove, thereby applying a spring force to the shank and causing it to engage the groove side with some degree of tightness which will thereby prevent or attenuate the transmission of vibrations from either of the butts 15*a* or 15*b* to the hook of the needle 10 such vibrations travelling along a path from the butt, into the shank and to the hook. The spring 19 is located adjacent the path, in particular being beneath the butt which is closest to the hook, for most effective attenuation of vibrations so as to substantially diminish the frequency and amplitude of vibrations which reach the hook, or which travel towards the hook, so as to thereby reduce both metal fatigue and needle breakage from this cause, and to diminish the chance that the hook of the needle will strike the hook of another needle, thereby causing breakage of one or the other of the needles.

Referring now to FIG. 2, there is shown a knitting machine needle generally designated 20, which includes a shank 21, an integral needle portion 22, hook 23 and latch 24. There is provided only a single butt 25*a* at the rear end of the needle 20. The front of the needle 20 has a front cutout 26*a*, and the back of the needle 20 has a back cutout 26*b*, these cutouts being bounded by straight lines which are each at substantially 90° to the straight lines adjacent to them. It is to be noted that the shank 21 forwardly of the cutout 26*a* is of the full depth, having no cutout, and on this portion of the shank 21, as shown in FIG. 2A, there is provided a spring 29, generally similar to the spring 19, in shape. There being only the butt 25*a* on the rearward portion of the needle 20, the spring 29 is not placed under such rearward butt 25*a*, but is placed on the full depth portion of the shank 21 which is at the forward portion of the needle 20, relatively close to the hook 23.

Referring now to FIG. 3, there is shown a needle 30 having a shank 31, a hook portion 32, a hook 33 and a latch 34, together with a butt 35*a*. A front cutout 36*a* and a back cutout 36*b* are provided in the shank 31, being of substantially the same shape. Thus, cutout 36*a* has a first edge 36*c* which is generally parallel to the longitudinal axis of the needle shank 31, and this is intersected by a pair of other straight edges 36*d* and 36*e*, which are at angles substantially more than 90° to the edge 36*c*, being illustrated as at an angle of approximately 135°.

FIG. 3A provides a showing of a portion of the needle 30, having a spring 39 secured to it in the same manner as the needle 19, generally underlying the butt 35*a*, which will be seen to be on the forward portion of the shank 31 of the needle 30.

In FIG. 4, there is shown a knitting machine needle 40 having a shank 41, hook portion 42, hook 43 and latch 44, together with a butt 45*a* and a pair of cutouts 46*a* and 46*b*. Each of these cutouts is provided with a first edge, such as the edge 46*c* which is generally parallel to the longitudinal axis of the needle shank 41. A second edge 46*d* is at an angle substantially greater than 90° to the edge 46*c*, while an edge 46*e* is at an agle which is substantially less than 90° to the edge 46*c*. The front and back cutouts 46*a* and 46*b* are adjacent to each other, and have an inclined portion 41*a* of the shank between them, extending from the front of the needle shank to the back of the needle shank, and being inclined away from the hook 43.

FIG. 4A shows a portion of the needle 40, and is provided with a spring 49, generally similar to the spring 19, being located in a substantially underlying relationship to the butt 45*a*.

FIG. 5 discloses a needle generally designated 50 having a shank 51, hook portion 52, hook 53 and latch 54, together with a front butt 55*a* and a rear butt 55*b*. There are provided a front cutout 56*a* and a rear cutout 56*b*, each made up of edges which are generally parallel to the longitudinal axis of the needle 50, together with additional edges which are each substantially more than and substantially less than 90° to the noted parallel edge. In this embodiment, however, the inclined portion 51*a* of the shank 51 which is between the cutouts 56*a* and 56*b* extends from the front to the back of the shank, and is inclined towards rather than away from, the hook 53.

FIG. 5*a* shows a needle 50 having a spring 59 for attenuating vibrations.

FIG. 6 discloses a portion of a machine needle 60 characterized by a shank 61, butt 65*a*, and front and back cutouts 66*a* and 66*b*. Each of these cutouts is provided and defined by a first edge which is generally parallel to the longitudinal axis of the needle 60, and two additional straight edges which are at angles less than 90° to the noted longitudinally extending and parallel edge. In addition, the inclined portion 61*a* of the shank 61 extends in the same manner as the inclined portion 41*a* of the needle 40. A spring 69 may be provided, as shown, underlying the butt 65*a* which is located on the forward portion of the needle 60.

There have been provided disclosures of knitting machine needles for use in circular dial and cylinder knitting machines, provided to reduce needle vibration and consequent needle breakage. These needles are characterized by having both front and back cutouts, and these cutouts are provided with edges extending longitudinally of the needle, generally parallel to the needle longitudinal axis, and a pair of additional edges, which may be arcuate inclined at an angle of more than 90° to the noted longitudinal edge, at an angle of less than 90° thereto, and in some instances, have one edge more and one edge less than 90° to the noted edge. These cutouts provide for attenuation of vibrations introduced into the needle, by engagement of a butt or butt thereof with the cams of the knitting machine, so as to diminish the vibration which reaches the hook. In addition, further attenuation of the vibrations introduced into the needles is achieved by the provision of a spring on the side of the needle shank, the spring being provided on the hereinabove described needles, as well as on a needle having front and back cutouts in which all of the edges are substantially perpendicular to the edges adjacent thereto. These springs, by urging the needle shank against the groove wall, and being located under the butt closest to the hook where there is a forwardly positioned butt, and being located at the forward portion of the needle where there is only a butt or butts at the rear of the needle, serve to attenuate vibrations travelling towards the hook.

It will be obvious to those skilled in the art that various changes may be made without departing from the spirit of the invention and therefore the invention is not limited to what is shown in the drawings and described in the specification but only as indicated in the appended claims.

I claim:

1. For use in a high speed circular knitting machine having a dial and cylinder provided with needle grooves and cams for moving the needle in said grooves, a needle comprising a flat sheet metal shank of generally rectangular transverse cross section and having an integral needle portion extending therefrom and having a hook, the needle shank having a groove contacting back and a front provided with butt means adapted for engagement with cams of a knitting machine, said needle having cut-out means at the back and at the front of the shank, said cut-out means each comprising an edge generally parallel to the longitudinal axis of the needle shank, and arcuate edges joined thereto, and spring means on the side of said needle shank and located on said shank adjacent the path of travel of vibrations from said butt means toward said needle hook for attenuating vibrations generated in said shank by engagement of said butt means with the cam of the knitting machine, whereby to reduce the transmission of vibrations to the needle hook.

2. For use in a high speed circular knitting machine having a dial and cylinder provided with needle grooves and cams for moving the needle in said grooves, a needle comprising a flat sheet metal shank of generally rectangular transverse cross section and having an integral needle portion extending therefrom and having a hook, the needle shank having a groove contacting back and a front provided with butt means adapted for engagement with cams of a knitting machine, said needle having cut-out means at the back and at the front of the shank, said front and back cut-out means being adjacent and with an inclined portion of the shank between them extending from front to back of the shank and being inclined away from the hook, wherein said cut-out means comprises first and second edges oriented respectively substantially more than 90° and less than 90° to the longitudinal axis of the said needle shank.

3. The improved knitting machine needle of claim 2 and a spring carried by said shank for engaging the side wall of the needle groove, said spring being located on a side of the shank and located on said shank adjacent the path of travel of vibrations from said butt means towards said needle hook.

* * * * *